US006815617B1

(12) United States Patent
Gebs et al.

(10) Patent No.: US 6,815,617 B1
(45) Date of Patent: Nov. 9, 2004

(54) SERRATED CABLE CORE

(75) Inventors: Bernhart Allen Gebs, Richmond, IN (US); Benjamin Peralejo Clemente, Richmond, IN (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

(21) Appl. No.: 10/177,565

(22) Filed: Jun. 21, 2002

Related U.S. Application Data

(60) Provisional application No. 60/349,296, filed on Jan. 15, 2002.

(51) Int. Cl.[7] ..... H01B 7/00; H01B 7/18

(52) U.S. Cl. ..... 174/113 AS; 174/102 R; 174/103; 174/109

(58) Field of Search ..... 174/102 R, 102 SP, 174/105 R, 110 R, 111, 112, 113 R, 113 C, 115, 116, 28

(56) References Cited

U.S. PATENT DOCUMENTS

| | | | | | |
|---|---|---|---|---|---|
| 1,912,794 | A | * | 6/1933 | Peterson | 174/28 |
| 1,956,951 | A | * | 5/1934 | Hinsky | 174/112 |
| 2,167,538 | A | * | 7/1939 | Turk | 174/28 |
| 2,204,737 | A | * | 6/1940 | Swallow | 174/28 |
| 2,488,211 | A | * | 11/1949 | Lemon | 174/28 |
| 2,566,335 | A | * | 9/1951 | Joerren | 338/26 |
| 2,583,025 | A | * | 1/1952 | Swift et al. | 174/117 R |
| 2,583,026 | A | * | 1/1952 | Swift | 174/117 R |
| 3,341,385 | A | * | 9/1967 | Nago | 156/54 |
| 3,928,519 | A | * | 12/1975 | Kashiyama et al. | 264/40.7 |
| 4,011,118 | A | * | 3/1977 | Geominy | 156/51 |
| RE30,194 | E | * | 1/1980 | Bruno et al. | 431/207 |
| 4,408,089 | A | * | 10/1983 | Nixon | 174/34 |
| 4,626,810 | A | * | 12/1986 | Nixon | 333/243 |
| 4,758,685 | A | * | 7/1988 | Pote et al. | 174/29 |
| 4,767,890 | A | * | 8/1988 | Magnan | 174/28 |
| 5,212,350 | A | * | 5/1993 | Gebs | 174/102 R |
| 5,239,134 | A | * | 8/1993 | Pote et al. | 174/102 R |
| 5,262,593 | A | * | 11/1993 | Madry et al. | 174/102 R |
| 5,293,001 | A | * | 3/1994 | Gebs | 174/36 |
| 5,563,376 | A | * | 10/1996 | Hansell et al. | 174/102 R |
| 5,956,852 | A | * | 9/1999 | Tarpill | 30/90.3 |
| 5,990,419 | A | * | 11/1999 | Bogese, II | 174/120 R |
| 6,222,130 | B1 | * | 4/2001 | Gareis et al. | 174/113 C |
| 6,346,671 | B1 | * | 2/2002 | Ahrens et al. | 174/28 |

FOREIGN PATENT DOCUMENTS

| | | | | |
|---|---|---|---|---|
| EP | 0 373 120 A1 | * | 6/1990 | H01B/11/18 |
| JP | 03163712 A | * | 7/1991 | H01B/11/18 |

OTHER PUBLICATIONS

C & M Corporation, Engineering Design Guide (3rd Edition), Jan. 1992, p. 26.*

* cited by examiner

*Primary Examiner*—William H. Mayo, III
(74) *Attorney, Agent, or Firm*—Lewis, Rice & Fingersh, LC

(57) ABSTRACT

An axially arranged cable, such as a coaxial, triaxial, twinaxial, or armored cable which includes at least one serration on an insulative or conductive layer internal thereto and methods of manufacturing the same. These serrations may appear on insulators or inner jackets and are in physical contact with conductive layers such as shields which axially surround the insulative layers. The serrations generally increase the contact force between the insulative layers and the conductiver layers to help prevent separation of the cable core during stripping of the axial cable.

26 Claims, 4 Drawing Sheets

SERRATED CABLE CORE

CROSS REFERENCE TO RELATED APPLICATIONS

This application claims priority to U.S. Provisional Patent Application Ser. No. 60/349,296 filed Jan. 15, 2002, the entire disclosure of which is herein incorporated by reference.

BACKGROUND OF THE INVENTION

1. Field of the Invention

This disclosure relates to the field of cables. In particular to coaxial and triaxial cables for use with automatic stripping equipment.

2. Description of the Related Art

In the modern world, cables are everywhere. They are used to transmit numerous signals between individual electronic components which can range from the very basic building blocks of electrical systems to the most cutting-edge consumer and commercial devices. One of the most common of these is the coaxial cable which can be used for everything from connecting a DVD player to a TV, to connecting sophisticated medical apparatus to processing computers, to hooking up components of computer or telecommunications networks.

As the coaxial cable (and the related triaxial cable) have come into increased use in both consumer and commercial contexts, the need for more and more finished cable assemblies to be produced has become greater. While cable can be manufactured on large rolls using modern assembly techniques, for many applications the cable needs to have terminators attached to the ends and/or be otherwise "finished" so it can connect to the devices which are to be interconnected by the cable in a simple, repeatable, and understandable fashion. Finished cable manufacturers/assemblers therefore process the rolls of raw cable into the 3', 10', 100' or other desired length "cables" that most people are familiar with. The terminators for attachment to these cables come in a wide variety of forms, and the resultant cables are also generally produced in a wide variety of sizes and intended for a wide variety of applications. Just going down to any electronics store will present a consumer with a dizzying variety of finished cables and most electronics stores will stock hundreds if not thousands of feet of finished cables. Some will even stock raw cable and will provide a particular finished length upon demand by a consumer.

In addition to the retail consumer, businesses generally need significant quantities of cable to setup and maintain computer networks and other internal electrical systems. Some businesses even rely on cables as an essential part of doing business. For instance, television news organizations generally need cables in conjunction with their cameras to perform their duties. All these cables are generally finished to allow for easy connection and disconnection of the electronics. Even when cables are permanently attached to devices, electronics equipment manufacturers need to be able to prepare raw cable to be attached to those products (essentially making the product the cable terminator). There is therefore an increasing demand for cable to be cut to a desired length and prepared for attachment to a terminator whether for finished cable construction or direct attachment to an end product.

To help in understanding how a cable is prepared for this attachment, a coaxial cable cross section should be visualized. The cable consists of a series of concentric cylinders or cylindrical tubes each surrounding the previous. The tubes are arranged so that there are alternating conductor and insulator layers. Two of each in a coaxial cable, while a triaxial cable simply adds one additional conductor and insulator outside the coaxial to form additional concentric layers. Larger axial cables may add additional alternating layers. To connect raw axial-style cable to terminators is conceptually fairly simple. Each of the internal conductors needs to be attached to an appropriate position on the terminator so that when the terminator is attached to a source, the appropriate signal is sent down the cable.

Because of the axial design of these cables, the conductors are generally insulated from external exposure (an insulator is the outermost layer) down their entire length (longitudinal dimension). Connecting to the extreme ends of the cylinder can be difficult, so generally a portion of the outermost tubes of the cables are stripped off the ends of the cable for a predetermined longitudinal distance from the end of the cable. This increases the surface area of the conductors available for each connection by allowing access to some of their longitudinal surface area. These stripped portions are then used to connect to the terminator resulting in good electrical connection between the cable and the terminator.

Because of the axial arrangement of the conductors and insulators, stripping a coaxial or triaxial cable generally involves a cutting tool cutting into the cable to a particular depth at a set distance from the cable end, and then the portions of the cable above this depth being "stripped" away by being pulled off the end of the portions that are to remain. This may be repeated at multiple different longitudinal distances and depths to get the desired exposure of all the various conductors present in the cable.

When making cables that are incorporated into devices which are mass produced, or when mass producing finished cables for the market, the above procedures are often accomplished by specialized machines that cut and strip the cables at great speeds to prepare them for attachment. One such machine is the PowerStrip 9500 RS Automatic cut and strip machine manufactured by Schleuniger and available commercially. These stripping machines, however, need to be able to strip the wire in a consistent and repeatable manner so that the cable is correctly stripped in preparation for the terminator attachment. This requires the stripping machine to be able to exert a particular force which is great enough to fully separate and strip off the undesired portions of the cable, but is not sufficient to damage the portions of the cable which are not to be removed.

With the advent of these machines, it was discovered that for the machine to be able to effectively remove the inner layer(s) (particularly the innermost insulator, often called the insulation, from the innermost conductor), such force was required on the pull step that the inner conductor(s) and inner insulator(s) (the cable core) would be pulled from within the cable, rendering the cable non-functional.

To combat this problem, multiple ideas have been proposed. These include increasing the contact force between the shield and the core by using tighter jackets to compress the shield, by using more rigid jackets, by using less rigid insulators, or heating the shield and insulators to get a better adhesion with at least some of the conductors. The problem with these methods is that they often do not solve the underlying issue of the stripping machine damaging the cable while attempting to strip it, and may add unnecessary cost. Tighter jackets or heat generated bonds often result in too much resistance between the components causing the stripping machine to fail to strip the cable and instead only partially separating the layers creating an unusable portion. Less rigid insulators help with the stripping problem by allowing the shield to cut into the insulator, but the result is a less rigid cable than is desired for many applications. Rigid jackets can also help with the stripping problem, but the resultant cable is more rigid than is desirable for many applications.

BRIEF SUMMARY OF THE INVENTION

Because of these and other previously unknown problems in the art, disclosed herein is an axial cable, such as, but not limited to, a coaxial, triaxial, twinaxial, or armored cable, which includes at least one serration on an insulative or conductive layer internal thereto. These serrations may appear on insulators or inner jacket layers and are in physical contact with conductive layers such as shields which axially surround the insulative layers. The serrations generally increase the contact force between the insulative layers and the conductive layers to help prevent separation of the cable core during stripping of the axial cable. Methods of manufacturing such cables are also disclosed.

Described herein, among other things, is an axially arranged cable comprising: an insulator having an outer surface; a shield axially surrounding the insulator; and at least one serration in physical contact with the outer surface of the insulator, the serration also in physical contact with at least a portion of the shield.

In an embodiment, the cable further comprises a jacket axially surrounding the shield. The shield in turn may comprise a metallic tape, a braid, wire, a serve, a double braid, a double serve, and/or a French Braid.

In an embodiment, the insulator axially surrounds a center conductor and/or at least two conductors which may be insulated from each other.

In an embodiment, at least one of the at least one serration runs generally longitudinally on the insulator, runs helically relative to the insulator, exists at a self-contained point on the insulator, includes a raised shape on the insulator, and/or includes an annular ring.

In an embodiment, the cable can comprise a coaxial cable, a triaxial cable, an armored cable and/or a twinaxial cable.

In another embodiment, disclosed herein is an axially arranged cable comprising: a center conductor; an insulator axially surrounding the center conductor and having an outer surface; an inner shield axially surrounding the insulator; an inner jacket axially surrounding the inner shield and having an outer surface; an outer shield axially surrounding the inner jacket; and at least one serration in physical contact with the outer surface of the inner jacket and in physical contact with at least a portion of the outer shield.

In yet another embodiment, the cable further comprises an outer jacket axially surrounding the outer shield. Either the inner shield or the outer shield may comprise a metallic tape, a braid, wire, a serve, a double braid, a double serve, and/or a French Braid.

In yet another embodiment, the cable includes a second serration in physical contact with the outer surface of the insulator and is in physical contact with at least a portion of the inner shield.

In yet another embodiment, at least one of the at least one serration runs generally longitudinally on the inner jacket, runs helically relative to the inner jacket, exists at a self-contained point on the inner jacket, includes a raised shape on the inner jacket, and/or includes an annular ring.

In yet another embodiment, described herein is an axially arranged cable comprising: a center conductor; an insulator axially surrounding the center conductor and having an outer surface; an inner shield axially surrounding the insulator; an inner jacket axially surrounding the inner shield; an outer shield axially surrounding the inner jacket; and at least one serration in physical contact with the outer surface of the insulator and in physical contact with at least a portion of the inner shield.

In a still further embodiment the cable further comprises an outer jacket axially surrounding the outer shield. Either the inner shield or the outer shield in turn may comprise a metallic tape, a braid, wire, a serve, a double braid, a double serve, and/or a French Braid.

In a still further embodiment, at least one of the at least one serration runs generally longitudinally on the insulator, runs helically relative to the insulator, exists at a self-contained point on the insulator, includes a raised shape on the insulator, and/or includes an annular ring.

In yet another embodiment, there is disclosed an axially arranged cable comprising: a center conductor; an insulator axially surrounding the center conductor and having an outer surface; a shield axially surrounding the insulator; and a plurality of serrations in physical contact with the outer surface of the insulator, the serrations also in physical contact with at least a portion of the shield. The cable may or may not include a jacket axially surrounding the shield.

In yet another embodiment, there is disclosed an axially arranged cable comprising: a conductor having an outer surface; an insulator axially surrounding the conductor; and at least one serration in physical contact with the outer surface of the conductor.

DETAILED DESCRIPTION OF THE PREFERRED EMBODIMENT(S) OF THE INVENTION

Although the cables and methods described below are discussed primarily in terms of their application to axially arranged cables such as, but not limited to, coaxial, triaxial, twinaxial, and armored cables for use with automatic stripping equipment, it would be understood by one of ordinary skill in the art that the principles, methods, and devices disclosed herein could also be used on other types of axially arranged cable, for other types of cables, and/or for cables either not designed to be stripped, or stripped by hand. Further, cables incorporating the principles, methods, or devices described herein can be used to carry any type of signal and can be attached to any type of connector or terminator for use in any environment.

The use of the term "serrated" or "serrations" in this disclosure will generally be used to refer to an object having teeth, ridges, peaks, points, projections and/or protrusions extending from the surface thereof. These serrations can be of any shape and are not limited to those having points or sharp edges. In an embodiment, they may specifically be rounded so as to avoid any sharp edges. Further, although a serration is generally referred to as extending from a surface, one of skill in the art would recognize that a serration may be formed by removing portions of a surface to form valleys, troughs or the like resulting in the creation of corresponding serrations extending from a new surface.

Figure 1:
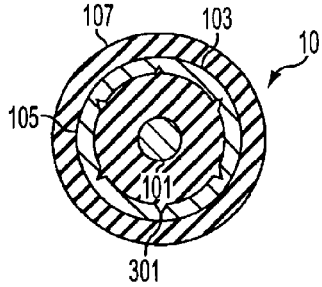
FIG. 1 depicts an embodiment of a cross-sectional end view of a coaxial cable including an embodiment of a serrated core.
Figure 2:
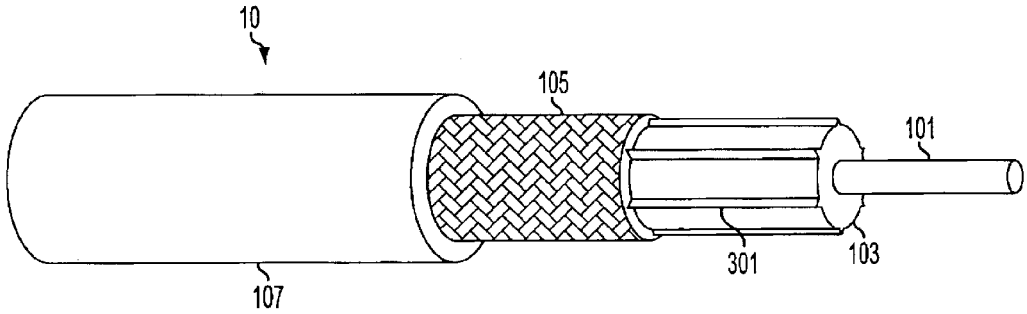
FIG. 2 depicts an embodiment of an isometric cut-away view of the coaxial cable shown in FIG. 1.

An embodiment of a serrated core for use with a coaxial cable (10) is shown in FIGS. 1 and 2. In this disclosure, a cable core will generally refer to all portions of the cable which are inside the outermost shield and/or outermost jacket with the innermost or internal position being defined in a cable as the center of the cable cylinder and the outermost or external position being the longitudinal outer surfaces of the cable cylinder. The cable is generally manufactured from a center conductor (101), which is formed of an electrically conductive material, upon which other materials are placed to form an axial arrangement thereon. This placement will generally be referred to as "axially surrounding" the prior layers and will generally mean that the layer surrounds the interior cylindrical layer(s) at all but the top and bottom of the cylinder even if not in physical contact therewith. Because of this arrangement, all layers, but the center, are essentially hollow tubes. The definitions in these paragraphs are intended to clarify the use of some terms, however, they are by no means intended to limit the meaning of any term as would be understood by one of ordinary skill in the art.

Generally, center conductor (101) is a metallic conductive wire formed in any manner as would be known to one of ordinary skill in the art, such as but not limited to, wire drawing. In most cables, the center conductor (101) is a generally wire shape, that is a flexible cylinder wherein the height of the cylinder is significantly larger than the diameter of the cylinder. Such a shape is, however, by no means required and the center conductor could have any shape. Alternatively, the center conductor (101) may be a braid, tape, or other conductive material or materials axially surrounding another insulator. In another embodiment, instead of a single center conductor (101) being used two or more conductors may be used. These conductors may take a variety of different forms and may or may not be electrically insulated from each other. In particular, the conductors may be helically twisted about each other in an embodiment, or alternatively, may run parallel to each other in another embodiment. In still another embodiment, combinations of these arrangements may be used in a single cable. In an embodiment, exactly two conductors are used in one of the above arrangements. This type of cable is generally referred to as a "twinaxial" cable.

The center conductor (101) is then generally axially surrounded by an insulator (103). The insulator (103) is generally an electrically insulative material such as, but not limited to, Polyethylene, Polypropylene, Fluorinated Ethylene-propylene (FEP), Polyvinylchloride (PVC), Polytetrafluoroethylene (PTFE), or other plastics, rubbers, papers, tapes or insulators which surround the longitudinal surfaces of the center conductor (101) leaving only the ends of the center conductor (101) accessible. In another embodiment, the insulator (103) can comprise layers or combinations of materials. These layers may be different insulators or in still another embodiment may include layers or substances which are semi-conductive. In still another embodiment, the insulator (103) may include air-gaps, spaces, or other designs so as to utilize air as part of insulator (103). One of ordinary skill in the art would understand that the use of the term "layers" within the insulator (103) allows for, but does not require, the layers to be created by separate steps. That is, the layers may be created independent of each other (separate extrusion steps) or may be created by simply combining different insulators in the process of forming the insulator (103). This insulator (103) is then axially surrounded in turn by another conductor (generally called a shield (105)) which is generally metallic and is designed to be electrically conductive. The shield (105) and the insulator (103) act in concert to electrically isolate the center conductor (101) from the external world helping to prevent stray electrical signals from being coupled onto the transmission line. The insulator (103) also generally prevents any electrical contact between the shield (105) and the center conductor (101) if both are carrying electrical signals.

Generally, the shield (105) will be constructed through known techniques. In some cases, the shield will be constructed by applying a thin and narrow sheet of metal, which may or may not be laminated or otherwise attached on a substrate such as, but not limited to, plastic (a metal tape), to the exterior surface of the insulator (103) to surround the exterior surface of insulator (103). In another type of cable, the shield (105) is generated from a plurality of wires or other conductive components which are woven or braided together about the insulator (103). In still other embodiments, shield (105) may comprise specific braided shields such as, but not limited to, a single braid, double braid, and/or "serve shield" as known to those of ordinary skill in the art, or a double serve such as, but not limited to the "French Braid" described in U.S. Pat. No. 5,303,630 to Gerald Lawrence, the entire disclosure of which is herein incorporated by reference. This braiding forms a tube of interlaced material which is electrically a single conductor and forms a shield (105). In still another embodiment, the two methods may be used in combination with a metal tape being placed on the insulator (103) and then having a material braided thereon (or vice-versa). This process can be repeated with multiple layers of braid and/or tape. In this case, the tape and braid together electrically form a single conductor and shield (105).

In the embodiment of FIGS. 1 and 2, after the shield (105) has been applied, the entire cable may then be covered by a second insulator or jacket (107) which is placed so as to surround the shield (105) and electrically isolate the shield (105) from other shields or metal that is adjacent to the cable. This jacket (107) is generally insulative and also can be used to provide a printable surface for the placement of identifying indicia of the cable, to make the cable a particular color, or to improve the resultant appearance of the cable. In another embodiment, the cable (10) does not include jacket (107) leaving shield (105) as the outermost layer. This type of construction may be referred to as an "armored cable".

The interface between the insulator (103) and the shield (105) is often the weak point of the cable during a stripping action. The interface between the center conductor (101) and the insulator (103) is generally strong because of the way the cable can be constructed. As the insulator (103) is often plastic or a similar material, the material can be extruded directly onto the center conductor (101) allowing it to shape during the extrusion process and to be in solid contact with center conductor (101). The shield (105), however, is generally applied after the extruded material has cooled (at least to some extent) to prevent deforming the extruded material by the shield's (105) application. The contact force (or resistance to longitudinal movement) between the shield (105) and the insulator (103) is therefore dependent on the resulting friction and/or force between the shield (105) and the insulator (103) necessary to move the insulator (103) longitudinally relative to the shield (105). When the shield (105) is braided, particularly, there are often relatively few contact points between the shield (105) and the insulator (103) as the braiding action of the wires forming the shield (105) can result in each individual wire having only a small percentage of its surface area in contact with the insulator (103). This can therefore lead to a stripping machine, which may need to exert sufficient force to separate the insulator (103) from the outer surface of the center conductor (101), exerting more force on the cable core (the insulator (103) and center conductor (101)), than the shield (105) can resist, pulling the core from the shield (105) and damaging or destroying the coaxial cable (10).

The contact force between the insulator (103) and the shield (105), is generally dependent on the relationship between the interior size of the shield (105) tube, and the exterior size of the core (particularly the exterior size of the insulator (103)). A shield (105) that is "tighter" has a smaller interior surface diameter relative to the insulator's (103) outer surface diameter compared to a shield (105) which is "looser." One of ordinary skill in the art would recognize, however, that a shield (105) can only be made so "tight" before either the machines for braiding it are unable to do so, the wires are subject to breaking, or the braiding is under so much strain that it can be damaged. Further, those of ordinary skill would understand that other factors can influence the contact force. In particular, one of the factors is the design of the braid, the braid angle (the higher the angle the higher the force applied to the core), and/or the size of the braid wire. With a larger or stronger (i.e. higher tensile strength) wire, more force can be applied while braiding without the individual wires breaking. The higher force applied to the braid wires will increase the contact force on the inner insulator.

In most applications, however, the shield (105) is forced to engage or embed into the outer surface of the insulator (103) to obtain some contact force. However, because of the regular, uniform cylindrical shape of the outer surface of the core/insulator (103), the contact force between the two components is often difficult to set at a particular desirable value because a small change in the interior surface diameter of the shield (105) tube is multiplied dramatically in the reduced area inside the tube and altering the braiding can create other undesirable results. The use of a tape shield involves different types of application, but many of the same issues are still present.

Figure 8:
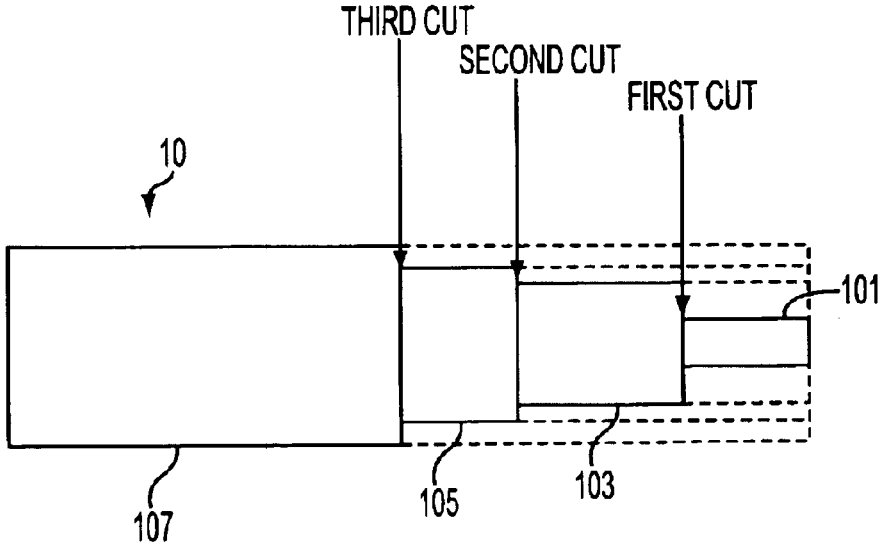
FIG. 8 depicts the cuts commonly made by a stripping machine to prepare a cable.

Typically, when machine stripping is used on a coaxial cable, such as coaxial cable (10) there are three cuts made as shown in FIG. 8. The blades first cut through the outer jacket (107), the shield (105), and the insulator (103) and removes that portion (First Cut). If the resistance of the shield (105) to the insulator (103) is too low, the insulator (103) is pulled out of the shield (105) of the remaining cable, and the insulator (103) is not removed from the center conductor (101). The machine will then cut through the jacket (107) and shield (105) and remove that portion of the cable (Second Cut). The final cut is made to remove the jacket (107) from the shield (105) (Third Cut). This results in a stepped stripped end as shown in FIG. 8. This process can be reversed (making the third cut the first etc.) with the jacket (107) removed first. If resistance between the jacket (107) and the shield (105) is too high the jacket (107) will not be removed properly as described. The resistance must be selected to be in a range where all operations can be performed without unintentionally altering the desired longitudinal strip lengths for each layer. That is, the resistance between the shield (105) and the insulator (103) for a given length needs to be greater than or equal to the resistance between the insulator (103) and the central conductor (101), while at the same time allowing a stripping machine to remove the jacket (107) from the shield (105).

As shown in FIGS. 1 and 2, the contact force between the insulator (103) and the shield (105) is increased, without the magnifying effect of decreasing the diameter of the shield (105), altering the braiding, or altering the resulting properties of the cable, by placing at least one serration (301) in physical contact with the inner surface of the shield (105). This physical contact may be achieved by either placing serrations (301) on the outer surface of a previously designed insulator (103), by removing portions of insulator (103) to form serrations (301), or by forming serrations (301) in conjunction with forming insulator (103). When a semi-conductive layer is used, the serrations may also be formed when that semi-conductive layer is applied, or may be later applied to the semi-conductive layer as discussed above for the insulator (103). These serrations (301) extend from the outer surface of the insulator (103) into the region which is normally occupied by the shield (105). When the shield (105) is braided or otherwise formed about the insulator, the shield (105) is generally sized based on the diameter of the outer surface of the insulator's (103) cylindrical tube forcing the shield (105) to be in physical contact with, and/or compress into the serrations (301) as the serrations (301) occupy the space that the shield (105) wishes to occupy. That is, the shield (105) can both embed into and/or compress the serrations (301) when it is attached and in physical contact. The serrations (301) can also increase the total external surface area of the insulator (103) allowing for more points of contact with the shield (105). This is particularly relevant when a tape is used.

Figure 6:
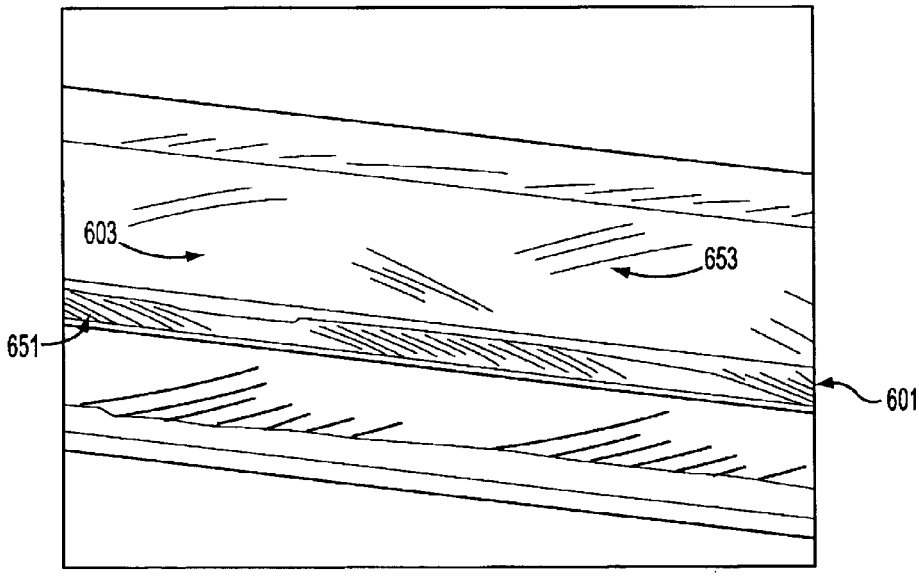
FIG. 6 depicts an embodiment showing how a braided shield embedded into and/or compressed a serration with the braid removed for clarity.

In the case of a braided shield (105), the embedding and/or compressing action serves to increase the contact force, while controlling the multiplier effect that is obtained by decreasing the inner diameter of the shield's (105) tube. As shown in FIG. 6, the indentations or impressions (651) formed by the braid (which has been removed for clarity) into the serration (601) are deeper and more pronounced than the indents (653) made by the braid into the underlying cylindrical tube of the insulator (603). As the contact force between the two components is proportional to the surface areas they have in contact, and as the wires of the braid relative to the insulator (603) are at an angle relative to the longitudinal length of the cable (the direction which the wire will be pulled by the stripping machine), the individual wires will have to be forced out of the indentation (651) by the stripping action. As is known to one of ordinary skill in the art, the deeper the indentation (651), the more force that will be required as the wires will each need to be deformed slightly to move them up and out of the indentation (651), and such deformation will require more force the deeper the indentation (651).

Figure 3:
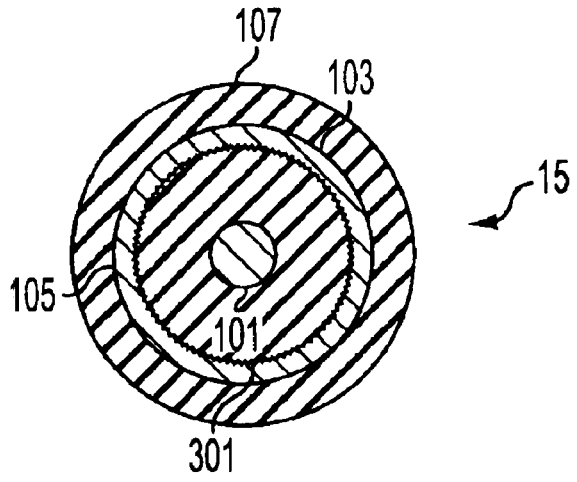
FIG. 3 depicts an embodiment of a cross-sectional view of a coaxial cable including an embodiment of a fully serrated core.

In the embodiment shown in FIGS. 1 and 2, there are six serrations (301) shown on the insulator (103) and those serrations (301) run longitudinally on the outer surface of the insulator (130). This is a preferable design for use with cables with approximately 0.120 inch insulator (103) diameter as the additional resistance formed by six serrations is in the range of what is necessary to prevent many automated stripping machines from pulling the cable core from the shield (105) during the stripping procedure. The number of serrations (301) may, however, be any from one up to the maximum number which can fit on the insulator (103) for a cable of any given size. For some sizes of cables, multiple different numbers and/or shapes of serrations (301) may produce similar net contact forces and be interchangeably useable. The maximum number of serrations (301) which may appear on a cable depends on a multitude of factors including the exterior diameter for the insulator's (103) cylindrical tube, and/or the size and/or shape of the serrations (301). In FIG. 3 there is shown an embodiment of a coaxial cable (15) where the insulator (103) is effectively covered by serrations (301) leading to that insulator being considered fully serrated. It should be noted that FIG. 3 is merely one embodiment of a fully serrated insulator (103). For serrations (301) of different shapes and/or sizes, for troughs of different shapes and/or sizes, and for cables of different shapes and/or sizes, different numbers of serrations (301) can be used while maintaining the insulator (103) as fully serrated.

While the number of serrations (301) depends upon the particular embodiment, the design of the serrations (301) can also depend upon the embodiment. In FIGS. 1 through 3 the serrations (301) are shown to run longitudinally on the outer surface of the insulator (103) turning the circular cross-section of the insulator (103) into a flower-like shape as shown in FIG. 1. The serrations (301), however, may appear in multiple other shapes. For instance, in another embodiment, the serrations (301) may form a helical pattern around the outer surface of the first insulator (103) possibly resembling a screw. In still another embodiment, the serrations (301) may be a plurality of annular rings encircling the insulator (103), in which case the number of serrations (301) would depend on the longitudinal spacing of the rings and the length of coaxial cable (10). In still another embodiment, the serrations could comprise self-contained points or "hills" which are surrounded on all sides by the first insulator's (103) outer surface. In a still further embodiment, the serrations (301) could be raised shapes, such as polygons, outlines, or other shapes, extending from the outer surface of first insulator (103). In a yet further embodiment, any combination or combinations of these types of serrations may be used on any single cable. It is also recognized that the serrations (301) in the embodiments depicted in the figures are arranged regularly and with even distribution across the outer surface of the insulator (103). In another embodiment, the serrations (301) may be placed to be randomly or semi-randomly distributed over the outer surface of the cylindrical tube of the insulator (103) or w may be in a combination of arrangements depending upon their longitudinal position on the insulator (103). The depicted serrations (301) are also shown to have a triangular cross-section. This design is also not necessary and in other embodiments the serrations may have any cross-sectional shape.

Figure 4:
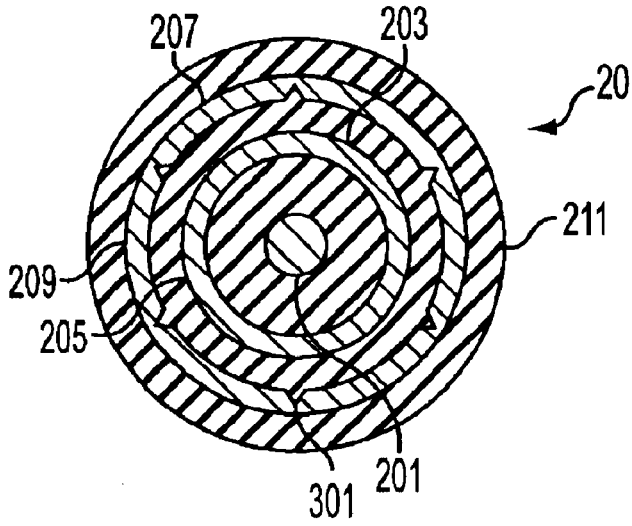
FIG. 4 depicts an embodiment of a cross-sectional view of a triaxial cable including an embodiment of a serrated core.
Figure 5:
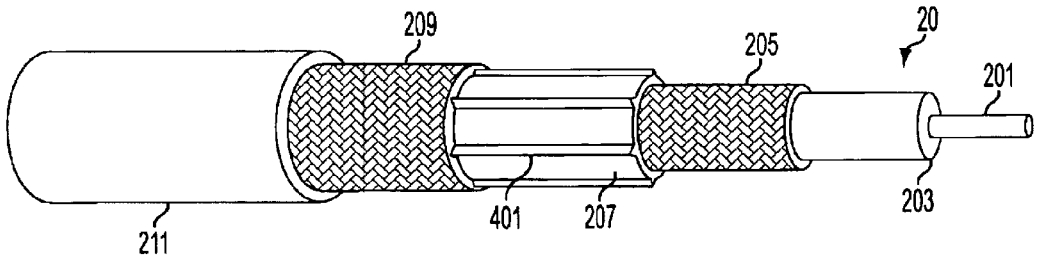
FIG. 5 depicts an embodiment of an isometric cut-away view of the triaxial cable shown in FIG. 4.

FIGS. 4 and 5 show an embodiment of serrations (401) as they can be used in an embodiment of a triaxial cable (20). Triaxial cable (20) has a generally similar construction to coaxial cable (10), however, triaxial cable (20) has three conductors/shields instead of the two conductors/shields of coaxial cable (101). Therefore, as shown in FIGS. 4 and 5, triaxial cable (20) is formed of a center conductor (201) generally having a shape similar to the center conductor (101) used in coaxial cable (10) as shown and described in conjunction with FIGS. 1 and 2 or any of the alternative constructions described previously including, but not limited to, the twinaxial configuration. The center conductor (201) is then axially surrounded by insulator (203) which may be constructed similarly to insulator (103). Insulator (203) is then in turn axially surrounded by a second conductor referred to as inner shield (205). Although not specifically shown in FIGS. 4 and 5, but as shown in FIGS. 1 and 2, insulator (203) may also include serrations (301) to improve the bonding between the insulator (203) and the inner shield (205) in the same manner as the insulator (103) and shield (105) in coaxial cable (10). Axially surrounding the inner shield (205) is then a second insulator referred to as inner jacket (207) which may be constructed in any of the manners discussed in conjunction with insulator (103). At this point the triaxial cable (20) may be essentially of identical construction as coaxial cable (10), or as a coaxial cable that does not include serrations (301). The triaxial cable (20), however, further includes a third conductor identified as the outer shield (209) which axially surrounds the inner jacket (207) and may include a third insulator identified as outer jacket (211) which axially surrounds the outer shield (209). An embodiment of a triaxial cable without outer jacket (211) is again generally referred to as an "armored cable." Similarly to coaxial cable (10), the shields of triaxial cable (20) are also electrical conductors and may be used for the transmission of electricity and/or electrical signals. In addition, also like coaxial cable (10), the jackets of triaxial cable (20) are generally insulators and are used to help isolate the outer conductors from outside metallic contact and for keeping the individual conductors from experiencing electrical contact within the individual cable.

In the embodiment of FIGS. 4 and 5, serrations (401) have been provided on the outer surface of the inner jacket (207) instead of the insulator (203). This embodiment may be particularly desirable if separation of the cable is prevalent between the inner jacket (207) and outer shield (209) but not between the insulator (203) and inner shield (205). In a triaxial cable, this would generally be called separation of the core. In another embodiment, both the inner jacket (207) and the insulator (203) can include serrations (401) and/or (301). As with the coaxial cable (10), the triaxial cable (20) can include serrations of any shape, size, or arrangement and the use of longitudinally oriented serrations in the FIGS. presents merely one of a plethora of available embodiments.

Figure 7:
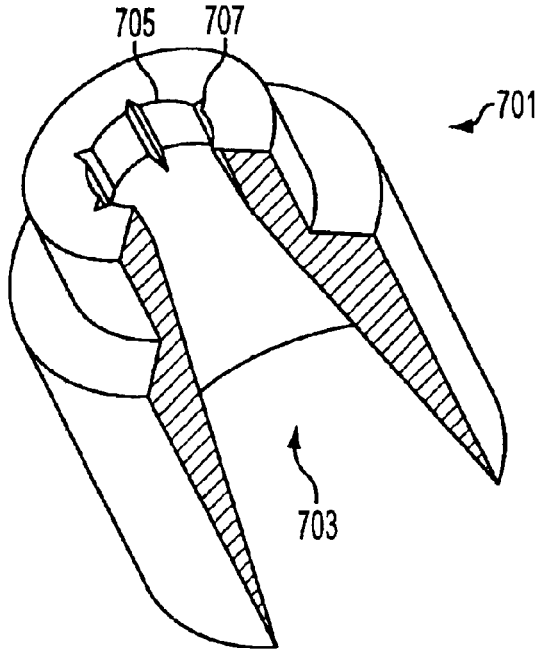
FIG. 7 depicts in cut-away an embodiment of a extrusion die which could be used to form a serrated core such as that shown in FIG. 1, 2, 4 or 5.

The manufacture of serrations (301) and/or (401), may be performed by a wide variety of a different methods. As was discussed above, however, the material used in insulators (103) or (203) as well as the insulators referred to as jackets (107), (207), and/or (211) may be extruded unto the underlying components during the cable's construction. One method for manufacturing the serrations (401) and/or (301) therefore can be accomplished by modifying the die through which at least some of the material to be used for the various components is extruded. One such die (701) is shown in FIG. 7. Die (701) includes a chamber (703) into which molten material is fed by apparatus as is known to one of ordinary skill in the art. The material is then forced through annulus (705) as the inner portions of the cable upon which the material being extruded is to be placed are passed through annulus (705). The annulus (705) of the die (701) includes groves (707) which correspond to the desired points for the placement of the serrations (401) and/or (301) of the cable. As would be well known to one skilled in extrusion, the shape of serrations (401) and/or (301) is determined by the shaping of groves (707).

Although the use of serrations has been specifically discussed herein with the serrations on the outer surface of an insulator internal to the axial cable, in a still further embodiment, the serrations could also be placed on the outer surface of a conductor, such as the inner conductor or any of the shields. Such a construction could be used to increase the strength of the attachment between the insulator and the conductor which that insulator axially surrounds. In a still further embodiment, serrations can be placed on multiple conductors and/or insulators so as to improve any of the internal connections of the cable. This could then be used to make a cable with particular, predetermined strengths between the different layers to improve the cable for use in a stripping machine still further, and/or to improve other properties of the cable.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

We claim:

1. An axially arranged cable comprising:

an insulator having an outer surface;

a shield axially surrounding said insulator; and at least one serration in physical contact with said outer surface of said insulator, said serration also in physical contact with at least a portion of said shield;

wherein said shield is at least partially embedded into said at least one serration and at least partially compresses said serration.

2. The cable of claim 1 further comprising a jacket axially surrounding said shield.

3. The cable of claim 1 wherein said insulator axially surrounds a center conductor.

4. The cable of claim 1 wherein said insulator axially surrounds at least two conductors.

5. The cable of claim 4 wherein said at least two conductors are insulated from each other.

6. The cable of claim 1 wherein said shield comprises a metallic tape.

7. The cable of claim 1 wherein said shield comprises a braid.

8. The axial cable of claim 7 wherein said braid comprises wire.

9. The cable of claim 7 wherein said braid comprises a serve.

10. The cable of claim 7 wherein said braid comprises a double braid.

11. The cable of claim 7 wherein said braid comprises a double serve.

12. The cable of claim 11 wherein said braid comprises a French Braid.

13. The cable of claim 1 wherein at least one of said at least one serration runs generally longitudinally on said insulator.

14. The cable of claim 1 wherein at least one of said at least one serration runs helically relative to said insulator.

15. The cable of claim 1 wherein at least one of said at least one serration exists at a self-contained point on said insulator.

16. The cable of claim 1 wherein at least one of said at least one serration includes a raised shape on said insulator.

17. The cable of claim 1 wherein at least one of said at least one serration includes an annular ring.

18. The cable of claim 1 wherein said cable comprises a coaxial cable.

19. The cable of claim 1 wherein said cable comprises a triaxial cable.

20. The cable of claim 1 wherein said cable comprises an armored cable.

21. The cable of claim 1 wherein said cable comprises a twinaxial cable.

22. An axially arranged cable comprising:

a center conductor;

an insulator axially surrounding said center conductor and having an outer surface;

a shield axially surrounding said insulator; and a plurality of serrations in physical contact with said outer surface of said insulator, said serrations also in physical contact with at least a portion of said shield;

wherein said shield compresses at least a portion of at least one of said plurality of serrations.

23. The cable of claim 22 further comprising a jacket axially surrounding said shield.

24. An axially arranged cable comprising:

an insulator having an outer surface;

a braided metallic shield axially surrounding said insulator; and a plurality of serrations in physical contact with said outer surface of said insulator, said serration also in physical contact with at least a portion of said braided shield in a manner so that said braided shield is at least partially embedded into said serrations and at least partially compresses said serrations to hold said braided shield to said insulator.

25. A coaxial cable consisting essentially of:

a center conductor;

an insulator axially surrounding said center conductor and having an outer surface;

a shield axially surrounding said insulator;

a plurality of serrations in physical contact with said outer surface of said insulator, said serrations also in physical contact with at least a portion of said shield; and a jacket axially surrounding said shield;

wherein said shield is at least partially embedded into and at least partially compresses at least one of said serrations.

26. An axially arranged cable comprising:

an insulator having an outer surface, said outer surface having an outer diameter;

a shield axially surrounding said insulator and having an inner surface, said inner surface having an inner diameter; and at least one serration in physical contact with said outer surface of said insulator and extending outward from said outer diameter, said serration also in physical contact with at least a portion of said inner diameter of said shield;

wherein said inner diameter and said outer diameter are substantially the same; and wherein said shield is at least partially embedded into said at least one serration and compresses at least a portion of said at least one serration.

* * * * *